United States Patent [19]

Heaney

[11] 4,080,756

[45] Mar. 28, 1978

[54] INSULATED REFRIGERATOR DOOR FRAME

[75] Inventor: James J. Heaney, Glendale, Calif.

[73] Assignee: Anthony's Manufacturing Company, Inc., San Fernando, Calif.

[21] Appl. No.: 621,202

[22] Filed: Oct. 9, 1975

[51] Int. Cl.[2] ..... E06B 7/12

[52] U.S. Cl. ..... 49/70; 49/501; 49/DIG. 1; 49/487

[58] Field of Search ..... 49/501, 504, 70, 487, 49/DIG. 1

[56] References Cited

U.S. PATENT DOCUMENTS

| | | | |
|---|---|---|---|
| 2,858,408 | 10/1958 | Barroero | 49/70 |
| 3,378,957 | 4/1968 | Frehse | 49/487 |
| 3,629,972 | 12/1971 | Rehberg et al. | 49/70 |

FOREIGN PATENT DOCUMENTS

| | | | |
|---|---|---|---|
| 112,571 | 1/1968 | Norway | 49/DIG. 1 |

*Primary Examiner*—Kenneth Downey
*Attorney, Agent, or Firm*—Kleinberg, Morganstern, Scholnick & Mann

[57] ABSTRACT

A channel-like structural member for use as a refrigerator door frame, having a generally U-shaped cross section including a first flange, a second flange, and an intermediate control portion wherein the improvement comprises a thermally insulative thermal barrier interposed between said central portion and said second flange, and holding those portions in rigid spaced-apart relationship.

13 Claims, 3 Drawing Figures

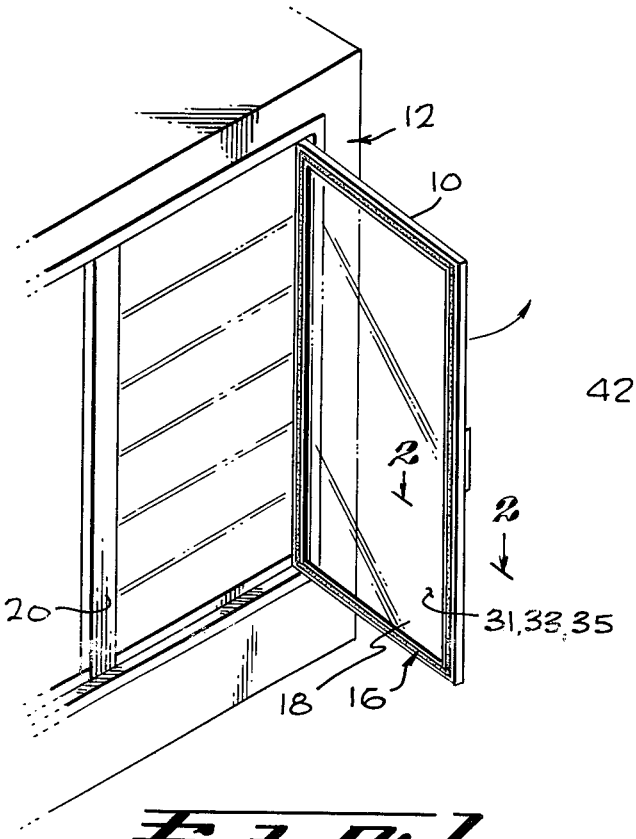
Fig. 1
Fig. 3
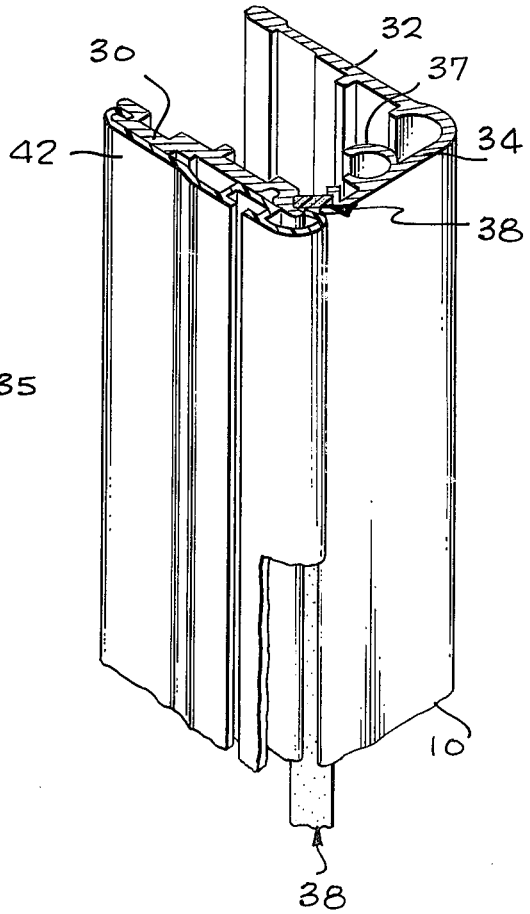
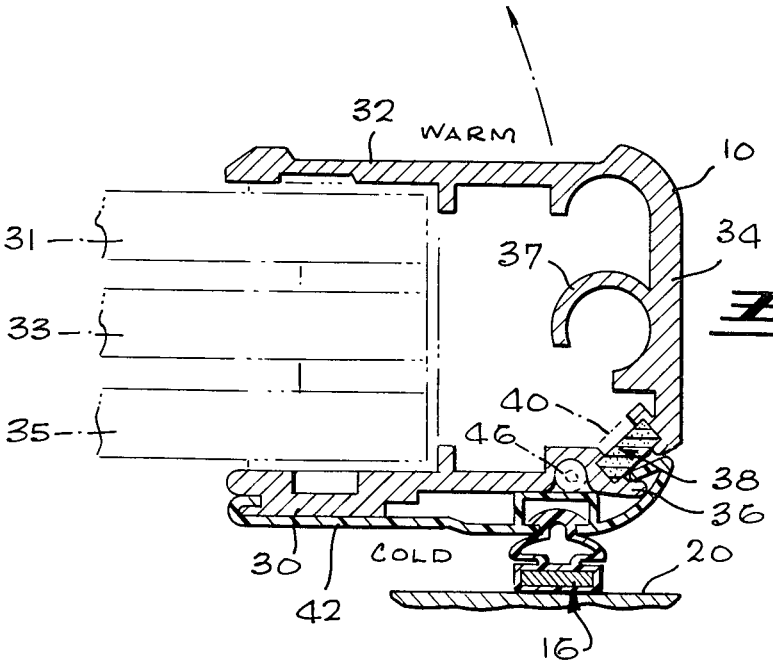
Fig. 2

INSULATED REFRIGERATOR DOOR FRAME

BACKGROUND OF THE INVENTION

1. Field of the Invention

The present invention relates to refrigerator cabinets and, more particularly, to a door frame structure for use with such cabinets.

2. Description of the Prior Art

Contemporary refrigerated cabinets are usually provided with doors having a large window area to enhance the display characteristics of the refrigerator. U.S. Pat. No. 3,724,129 to Stromquist, issued Apr. 3, 1973, shows a door frame of the contemporary type. The door is typically fabricated from a multi-pane glass panel which in turn is mounted in a metal supporting door frame.

The metal supporting frame is supplied with a gasket for forming a seal between the door frame and the frame in which the door is mounted. The front face of the door is surrounded by air at room temperature, while the inner face of the door is exposed to the cold air inside the refrigerator. Heat is absorbed by conduction from the air outside the refrigerator and is conducted through the metallic door frame around the edge of the door and into the cold portion of the door frame which is in contact with the cold air inside the refrigerator.

A temperature gradient exists from the warm portion of the door frame around the edge of the door and into the cold portion of the door frame. Because the door frame is typically made of metal, such as aluminum, rather large amounts of heat can enter the refrigerator by this conductive path, resulting in a great waste of energy and higher operating costs.

It is desirable to provide means for reducing the flow of heat from the warm portion of the door frame to the colder portion of the door frame to reduce the energy expended to maintain the refrigerated environment. One approach to this would be to simply construct the door frame from a material of relatively low thermal conductivity. This approach has not met with commercial success at this time because of the high cost of suitable materials.

In U.S. Pat. No. 3,204,324, issued Sept. 7, 1965, Nilsen shows a method for producing an insulating construction for structural members for use in window frames and like structures wherein the structural members on the warm and cold sides of the structural member are separated by an insulating spacer. That method includes providing originally a metal strip having a channel into which solidifiable insulative material is poured and allowed to solidify, then removing a part of the original strip forming the channel. This leaves a final structure consisting of two parts of the original strip bonded to the insulative material but spaced apart from each other by it, whereby the thermally conductive path between the two parts is interrupted by the insulative material. Nilsen, nowhere suggests use of the structural member formed by his method in a door frame for a refrigerator, and it will be seen that his structures are not totally suitable when applied to refrigerator door frames.

The applicability of the Nilsen technique to a door frame for a refrigerator is greatly complicated by the unique design constraints placed upon the refrigerator door frame. It is contemplated that the door frame construction of the present invention will preferably be used to form the entire periphery of the door. It is known in the art to pivot such doors from a torque-producing hinge pin to urge the door shut. The use of such a hinge pin results in large torques being applied to the central portion of the vertical door frame on the hinged side of the door. Likewise, the vertical door frame member to which the handle is normally attached is subject to repeated mechanical shock when the door is slammed shut in normal use. To reliably withstand these mechanical stresses, a refrigerator door frame using an insulative strip must be carefully conceived.

A second design constraint inherent in the refrigerator door frame is that those portions of the frame normally visible to the public must present an aesthetically clean and solid appearance. For this reason a structure is desired which enables placement of the insulative strip where it cannot readily be seen by the public.

In modern refrigerator doors the sealing means is not located on the edge of the door, but rather on the inner face of the door near its periphery. The temperature transition from cold to warm takes place in the vicinity of the seal. Therefore, if the insulative section were disposed across the central portion of the U-shaped frame member, a sizeable portion of the flange running along the inner face of the door would be exposed to the warm air outside the refrigerator, while another portion of the same flange would be exposed to the cold air inside the refrigerator. This would defeat the purpose of the insulative barrier, because heat would flow from the warm portion to the cold portion of the flange.

It is well known in the art to provide heater wires within the door frame to prevent the formation of condensation and frost on it. This was necessitated by the relatively good thermal path which prior art door frames provided, permitting heat to flow readily from the warmer outer portion of the frame into the portion of the door frame normally exposed to the cold air inside the refrigerator. The use of heater wires compounded the inefficiency of the unit, consuming electricity to supply additional heat to the colder portion of the door frame. It is an objective of the present invention to provide such an efficient door frame structure that the use of heater wires is unnecessary except under extreme conditions.

SUMMARY OF THE INVENTION

In accordance with the principles of the present invention it has been discovered that the flow of heat from the warm portion of the door frame to the colder portion can be greatly reduced, thereby effecting a considerable saving of energy, by inserting a thermally insulative section at an appropriate location in the door frame structure.

In the present invention the insulative portion is disposed between the central portion and the flange which extends along the inner face of the door. Thus, in the present invention, the insulative portion is located on the warm side of the thermal transition region.

The insulative section serves to restrict the area of the flange which is exposed to the warm air, thereby choking off the supply of heat which is conducted across the transition region into the colder region of the flange.

The resulting structure is highly effective, not requiring suplemental heating except under extreme conditions. This in turn results in reduced energy consumption and lower operating costs.

In the present invention, the central section of the U-shaped frame member is an integral part of the flange portion which lies along the outer face of the door. This results in a pleasing appearance of massiveness and cleanliness for those parts normally exposed to public view, combined with a structural configuration well adapted to handle the stresses to which door frames are subjected.

A thermal barrier is inserted into the door frame structure near the sealing gasket but on the warmer side of it, separating the structure into two parts, lying on opposite sides of the barrier. The first part extends into the warm air of the room surrounding the refrigerated cabinet and is generally maintained at room temperature. The second part extends from the insulating barrier past the sealing gasket and into the cold air inside the refrigerated cabinet, and its temperature is normally appreciably below room temperature. A portion of the second part near the insulating barrier extends into the warm air of the room. Because the entire second part of the door frame tends to be maintained at a temperature somewhat below room temperature, it is possible that under extreme conditions condensation will form on that part of the second portion of the door frame which is exposed to the air surrounding the refrigerated chamber.

To prevent condensation from forming on that portion of the second part, an electrical heating wire may be provided in proximity to that part to warm it above the dew point of the surrounding air as is known in the art. Substantially less electricity is required by the heater wire in the structures of the present invention because very little heat can flow into the second part owing to the relatively small portion of such part which is exposed to the surronding air.

Thus, the present invention is directed toward an energy-saving construction for a refrigerator door frame, using an insulative thermal barrier in a novel manner uniquely compatible with the constraints inherent to refrigerator doors, and having provision for electrically heating a part of the door frame when required by environmental conditions.

The novel features which are believed to be characteristic of the invention, both as to organization and method of operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

BRIEF DESCRIPTION OF THE DRAWINGS

FIG. 1 is a perspective view showing how the refrigerator door frame relates to the refrigerated cabinet;

FIG. 2 is a sectional view illustrating a preferred embodiment of the present invention; and FIG. 3 is a perspective view partially in section illustrating a preferred embodiment of the present invention.

DESCRIPTION OF THE PREFERRED EMBODIMENT

Referring now to the drawings, there is shown in FIG. 1 a commercial refrigerated cabinet 12, having a door with a door frame 10 of typical contemporary construction. A sealing gasket 16, typically of a magnetic type as shown, is disposed around the perimeter of the inner face 18 of the door. This magnetic sealing gasket 16, which is attached to the door, seals against a portion of the door mounting frame 20 as is known in the art. That portion of the door mounting frame is typically a smooth plane surface typically of ferromagnetic material lying substantially parallel to the plane of the door in its normally closed position. As used herein, ferromagnetic material is defined as material strongly attracted by a magnet. Portion 20 of the door mounting frame will be referred to as a faceplate inasmuch as typically it has the form of a thin plate of ferromagnetic material covering a chamber or conduit in the door mounting frame.

FIG. 2 is a sectional view showing a preferred embodiment of the door frame 10 of the present invention. The function of the door frame is to protect, support, and clamp together the panes of glass 31, 33 and 35 which form the body of the door and which provide high visibility of the contents of the refrigerated cabinet combined with relatively low thermal loss. Thus, the door frame must be capable of carrying structural loads; at the same time, it is desired to reduce the thermal losses associated with the door frame to a minimum.

As shown in FIG. 2, the door frame includes a warm flange portion 32 extending on the outer face of the door and into the air of the room outside the refrigerator, a cold inner flange portion 30 extending on the inner face of the door into the cold air inside the refrigerated cabinet, a central portion 34 lying along the edge of the door, and insulative portion 38 interposed between the portion 30 and 34 and holding them in rigid separation.

The door frame member shown in FIG. 2 is intended for use all around the edge of the door. When used at the hinged side of the door, region 37 of portion 34 encircles a torquing hinge pin (not shown) which pin defines the axis around which the door swings and which applies a torque to the door frame urging the door to its normally closed position. Because of this torque, relatively great forces act on the central portion 34, which must accordingly be of strong construction. A plastic strip 42 is attached to the inner structural portion 30 of the door frame for the purpose of attaching magnetic sealing gasket 16 to the door frame.

In the preferred embodiment, it is contemplated that the insulative portion 38 could be produced, for example, by the technique described in U.S. Pat. No. 3,204,324, issued Sept. 7, 1965, to Nilsen. That is, parts 30 and 32 would initially be a single piece connected by portion 40 indicated by phantom line in FIG. 2. Portions 30 and 34 include regions defining a channel adjacent to portion 40 into which a high density polyurethane plastic in liquid form is flowed. After the plastic has solidified, section 40 is milled away leaving portions 30 and 32 connected only by the polyurethane insulative portion 38. Portion 38 thus thermally isolates portion 34 from 30, while holding those portions in a rigid spaced apart relationship.

As can be seen from FIG. 2, only a small part 36 of portion 30 is exposed to the warm air surrounding the refrigerated cabinet. Because part 36 is relatively small, relatively little heat is conducted into that portion from the surrounding air, and as a result relatively little heat can be transferred to the part of 30 which extends into the cold air inside the refrigerated cabinet.

Under conditions of high ambient relative humidity it is possible that a small amount of condensation could form on the small part 36. To eliminate this tendency of condensation to form, a groove is supplied in portion 30 for retaining and positioning an optional electrical heating wire 46 shown by phantom lines in FIG. 2. Electrical heating wire 46 is normally required only under extreme conditions, such as where the temperature inside the refrigerated cabinet is extremely low and the relatively humidity outside the refrigerated cabinet is unusually high.

FIG. 3 is a perspective view partly in section showing the door mounting frame of the preferred embodiment.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. A door frame structural member for use in a door of a refrigerated cabinet, said member having the general form of a channel of U-shaped cross-section, comprising:

a first flange portion adapted to be exposed, in the door's normally closed position, to the normally warmer air outside the refrigerated cabinet;

an intermediate central portion integral with said first flange portion and substantially perpendicular to it;

a second flange portion substantially parallel with said first flange portion and disposed in spaced relation to said first flange portion, a part of said second flange portion adapted to extend, in the door's normally closed position, into the normally colder air inside the refrigerated cabinet and a part of said second flange portion nearest said intermediate central portion adapted to extend into the normally warmer air outside the refrigerated cabinet; and a thermal barrier portion of thermally insulative material interposed between said second flange portion and said intermediate central portion and holding those portions in rigid spaced-apart relationship, whereby heat absorbed by said intermediate central portion is prevented from entering the interior of the refrigerated cabinet via said second flange portion.

2. The structural member of claim 1 wherein said second flange portion further comprises a heated wire groove disposed adjacent said thermal barrier portion.

3. The structural member of claim 2 further comprising a heater wire disposed in said heater wire groove.

4. The structural member of claim 1 wherein said second flange portion further comprises gasket attaching means for attaching a sealing gasket to said second flange.

5. The structural member of claim 4 further comprising a sealing gasket attached to said second flange portion by said gasket attaching means.

6. The structural member of claim 1 wherein said second flange portion further comprises:

a heater wire groove disposed adjacent said thermal barrier portion;

gasket attaching means for attaching a sealing gasket to said second flange;

a heater wire disposed in said heater wire groove; and a sealing gasket attached to said second flange portion by said gasket attaching means.

7. A structural member for use in a door frame of a glazed door for a refrigerated display case, said member extending along and enclosing the edges of the glazed central portion of the door and having the form of a channel of U-shaped cross-section extending from the outer face of the door normally facing the exterior of the display case around the edge of the door to the inner face of the door normally facing the interior of the display case, said structural member comprising:

a first flange portion extending on the outer face of the door and exposed to the normally warmer air outside the display case;

an intermediate central portion integral with said first flange portion and substantially perpendicular to it, extending along an edge of the door;

a second flange portion substantially parallel with said first flange portion and disposed opposite said first flange portion on the inner face of the door, a part of said second flange portion extending into the normally colder air in the interior of the display case and a part of said second flange portion nearest said intermediate central portion extending into the normally warmer air outside the display case; and a thermal barrier portion of thermally insulative material interposed between said second flange portion and said intermediate central portion extending along the intersection of the edge of the door with the inner face of the door, and holding said second flange portion and said intermediate central portion in a rigid spaced-apart relationship; whereby said thermal barrier portion substantially blocks the flow of heat from the normally warmer air outside the display case to the normally colder air in the interior of the display case.

8. The structural member of claim 7 wherein said second flange portion further comprises a heater wire groove adjacent said thermal barrier portion whereby a heater wire can be positioned proximate said thermal barrier portion.

9. The structural member of claim 8 further comprising a heater wire disposed in said heater wire groove for heating that part of said second flange portion which extends into the normally warmer air outside the display case, to prevent moisture in the warmer air from condensing on that part of said second flange portion.

10. The structural member of claim 7 wherein said second flange portion further comprises gasket attaching means for attaching a sealing gasket to said second flange.

11. The structural member of claim 10 further comprising a sealing gasket attached to said second flange portion by said gasket attaching means, whereby when the door is swung to its normally closed position against a door mounting frame, said sealing gasket engages the door mounting frame in partable sealing contact.

12. The structural member of claim 7 wherein said second flange portion further comprises:

a heater wire groove adjacent said thermal barrier portion;

gasket attaching means for attaching a sealing gasket to said second flange portion;

a heater wire disposed in said heater wire groove, for heating that part of said second flange portion which extends into the normally warmer air outside the display case, to prevent moisture in the warmer air from condensing on that part of said second flange portion; and a sealing gasket attached to said second flange portion by said gasket attaching means whereby when the door is swung to its normally closed position against a door mounting frame, said sealing gasket engages the door mounting frame in partable sealing contact.

13. A channel-like structural member for use as a frame member of a refrigerated cabinet door, said member having a U-shaped cross-section including a first flange exposed, in the normally closed position of the door, to the normally warmer air outside the refrigerated cabinet, an intermediate central portion integral with the first flange, a second flange having, in the normally closed position of the door, a portion extending into the normally colder air inside the refrigerated cabinet and a portion nearest the intermediate central portion extending into the normally warmer air outside the refrigerated cabinet wherein the improvement comprises in combination:

a thermally insulative thermal barrier interposed between said second flange portion and said intermediate central portion, holding those portions in rigid spaced-apart relationship;

a heater wire groove in said second flange portion adjacent said thermal barrier portion; and a heater wire disposed in said heater wire groove.

* * * * *